United States Patent [19]

Katayama et al.

[11] 4,032,137

[45] June 28, 1977

[54] FEED CASSETTE DEVICE

[75] Inventors: Hajime Katayama; Hiroshi Nitanda; Tateki Nagaoka, all of Tokyo; Hirotoshi Kishi, Higashi Murayama; Yousaku Takada, Tokyo; Noriyoshi Iida, Ichikawa; Tsuneki Inuzuka, Fuchu; Yutaka Komiya, Tokyo, all of Japan

[73] Assignee: Canon Kabushiki Kaisha, Tokyo, Japan

[22] Filed: Oct. 20, 1975

[21] Appl. No.: 624,183

[30] Foreign Application Priority Data

| | | |
|---|---|---|
| Oct. 22, 1974 | Japan | 49-121823 |
| Dec. 5, 1974 | Japan | 49-147626[U] |
| Dec. 5, 1974 | Japan | 49-147627[U] |

[52] U.S. Cl. ..... 271/164; 271/160; 271/170; 271/145

[51] Int. Cl.[2] ..... B65H 1/04

[58] Field of Search ..... 271/126, 127, 145, 160, 271/162–164, 170, 171; 242/55.19 A; 206/387; 360/94, 132

[56] References Cited

UNITED STATES PATENTS

| | | | |
|---|---|---|---|
| 3,672,665 | 6/1972 | Schnall et al. | 271/164 |
| 3,767,188 | 10/1973 | Rosenberg, Jr. | 271/145 |
| 3,919,972 | 11/1975 | Komori et al. | 271/160 |
| 3,959,623 | 5/1976 | Nakahara | 271/164 |

FOREIGN PATENTS OR APPLICATIONS

| | | | |
|---|---|---|---|
| 18,944 | 8/1968 | Japan | 242/55.19 A |

OTHER PUBLICATIONS

Hustis et al.; "Mask Transportation and Storage Container"; IBM Technical Disclosure Bulletin; vol. 14, No. 8; 1–1972.

*Primary Examiner*—Robert W. Saifer

[57] ABSTRACT

In a feed cassette device which comprises a cassette corresponding in size to copy mediums to be contained therein, and a cassette table suited to receive the cassette thereon, the cassette has a positioning guide member and the cassette table has a cassette positioning portion and a member for urging the cassette toward the positioning portion. The feed cassette device also has means for locking the cassette in a predetermined position when it is loaded on the cassette table.

8 Claims, 12 Drawing Figures

FEED CASSETTE DEVICE

BACKGROUND OF THE INVENTION

1. Field of the Invention

This invention relates to an automatic copy medium feed cassette in electrophotographic or other copying machines or simple printing machines or the like, and also to a feed cassette device for the loading of such cassette into the machines.

2. Description of the Prior Art

One of the functions required of copying machines, printing machines or the like is to ensure a proper positional relationship between an original and its reproduction. Unless such a relationship is ensured between the original and a copy medium of the same size as the original on which the original is to be copied, the full original image will not be copied. It is also very undesirable that such positional deviation be irregular during each copy cycle or that the positional relationship be lost or varied each time a cassette of one paper size is interchanged with a cassette of another paper size.

Copy mediums to be contained in a cassette include transfer paper for use with the image transfer type copying machines, photosensitive paper for use with the electrofax system, and paper for use with simple printing. However these copy mediums, if they absorb moisture or the like due to variations in ambient conditions, will present poor separability from one another and a plurality of them will be fed at a time, or the performance as copy medium may be reduced to provide a low quality of copy image and further, in the case of the image transfer system, the copy mediums will undergo waving which will in turn lead to a poor image transfer effect.

SUMMARY OF THE INVENTION

A concept of the present invention lies in providing, in the so-called cassette system whereby cassettes respectively containing therein different types or sizes of copy mediums are selectively loaded onto a cassette table in the machine body to feed a desired type or size of copy mediums, a cassette loading device which will permit the overall size of the cassette to be variable with the size of the copy mediums contained therein and which will rationally match the system adopting one edge of the copy mediums as the reference.

A further concept of the present invention lies in providing a feed cassette device for protecting copy mediums contained in the cassette against variations in the ambient conditions and for preventing the reduction in various performances which would otherwise result from moisture or other factors.

It is an object of the present invention to provide a feed cassette device which eliminates any deviation of copy mediums with respect to their regular loaded position.

It is another object of the present invention to provide a feed cassette device which is excellent in operability and permits the copy mediums to be positioned with high accuracy.

It is still another object of the present invention to provide a feed cassette device which holds the feed cassette stably.

Another object of the present invention is to provide a feed cassette device which shields the copy mediums in the feed cassette against the influence resulting from variations in the ambient atmosphere.

According to the present invention, the feed cassette is provided with positioning guide member and the cassette table is provided with a cassette positioning portion and a member for urging the cassette toward the positioning portion, whereby when the cassette is inserted into the cassette table, the positioning guide portion is guided by the cassette positioning member to thereby hold the cassette properly at its regular loaded position.

Further, the feed cassette has at one side thereof a regulating portion for regulating the position of the copy mediums and at the opposite position thereto an abutment portion movable in the direction in which the copy mediums are regulated, whereby the position of the copy mediums in the feed cassette may be reliably regulated.

Also, a grooved portion is provided around the periphery of the cassette body, a packing member having a lip is disposed in the grooved portion, and an outer cassette lid having a projected portion is provided on the cassette to provide hermetic sealing with the lid bearing against the lip of the packing member.

Further, in another form of the feed cassette, a resilient fin-like projection is formed in the lid of the cassette and may fit to the edge portion of the cassette body to thereby provide hermetic sealing.

Thus, according to the present invention, the feed cassette may be hermetically sealed simply by inserting the feed cassette into the cassette table and by closing the lid of the feed cassette, and may thus be protected against the influence of the ambient atmosphere.

Also, the copy mediums to be fed may be highly accurately positioned without any deviation with respect to their regular loaded position.

The above objects and other features of the present invention will become more fully apparent from the following detailed description of the invention taken in conjunction with the accompanying drawings.

DESCRIPTION OF THE PREFERRED EMBODIMENTS

Figure 1:
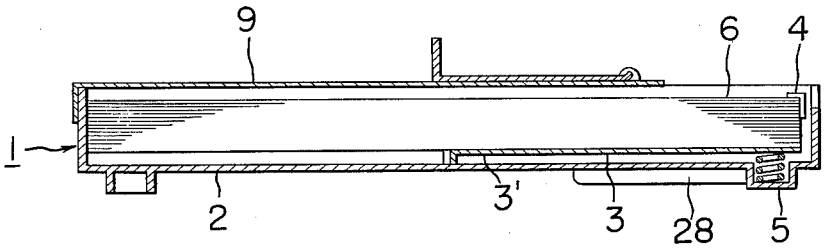
FIG. 1 is a vertical cross-section of an embodiment of the feed cassette device according to the present invention.
Figure 2:
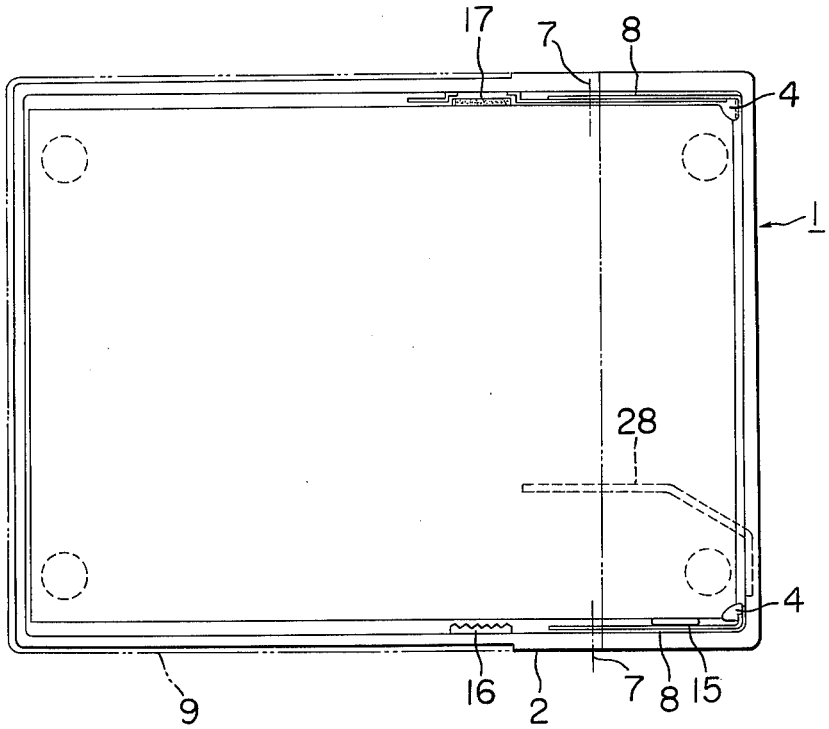
FIG. 2 is a plan view corresponding to FIG. 1.
Figure 3:
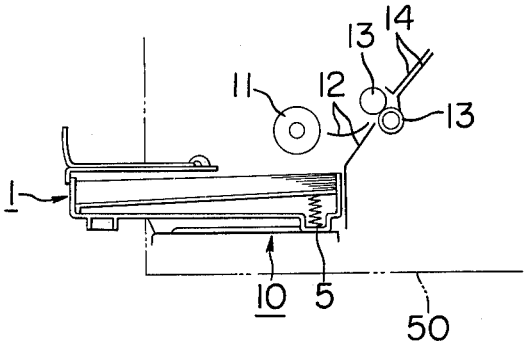
FIG. 3 is a side elevation of the feed cassette device as loaded into a copying machine.

Reference will first be had to FIGS. 1 to 3 to describe an embodiment of the feed cassette device. The cassette 1 comprises a cassette housing 2, a copy medium reception plate 3 and copy medium separator pawls 4. The copy medium reception plate 3 is supported with a tendency to be raised upwardly about the rear end 3' thereof by a spring 5, and a stock of copy mediums 6 may be set on the reception plate. The separator pawls 4 are mounted for vertical movement about a shaft 7, extending between and secured to the opposite side walls of the housing, by means of support members 8, and due to the gravity thereof the separator pawls hold down the stock of copy mediums set on the reception plate, at the forward end corners of the uppermost one of the copy mediums 6. Designated by 9 is the lid of the cassette. The cassette with the copy mediums 6 so set therein may be placed on a cassette table 10 provided in a copying machine 50. A feed roller 11 provided in the copying machine is downwardly movable into contact with the stock of copy mediums 6 only in response to a copy medium feeding signal, and rotatable about its own axis to feed the copy mediums one by one in succession into the copying machine. Even if the stock of copy mediums 6 is decreased, the copy medium reception plate 3 is correspondingly raised upwardly by the spring 5 so that the position of the top surface of the copy medium stock may always be maintained substantially at a predetermined level, and the strength of the spring 5 is chosen in relation to the thickness and weight of the copy medium stock so that the copy medium stock may be urged against the feed roller 11 always with a predetermined pressure force. Reference numeral 13 designates a pair of register rollers provided in the copying machine, and reference numerals 12 and 14 denote copy medium guide plates.

Figure 4:
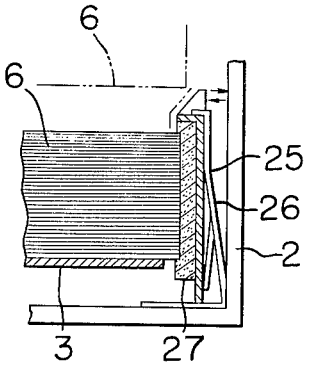
FIG. 4 is an enlarged fragmentary view of the abutment portion.
Figure 5:
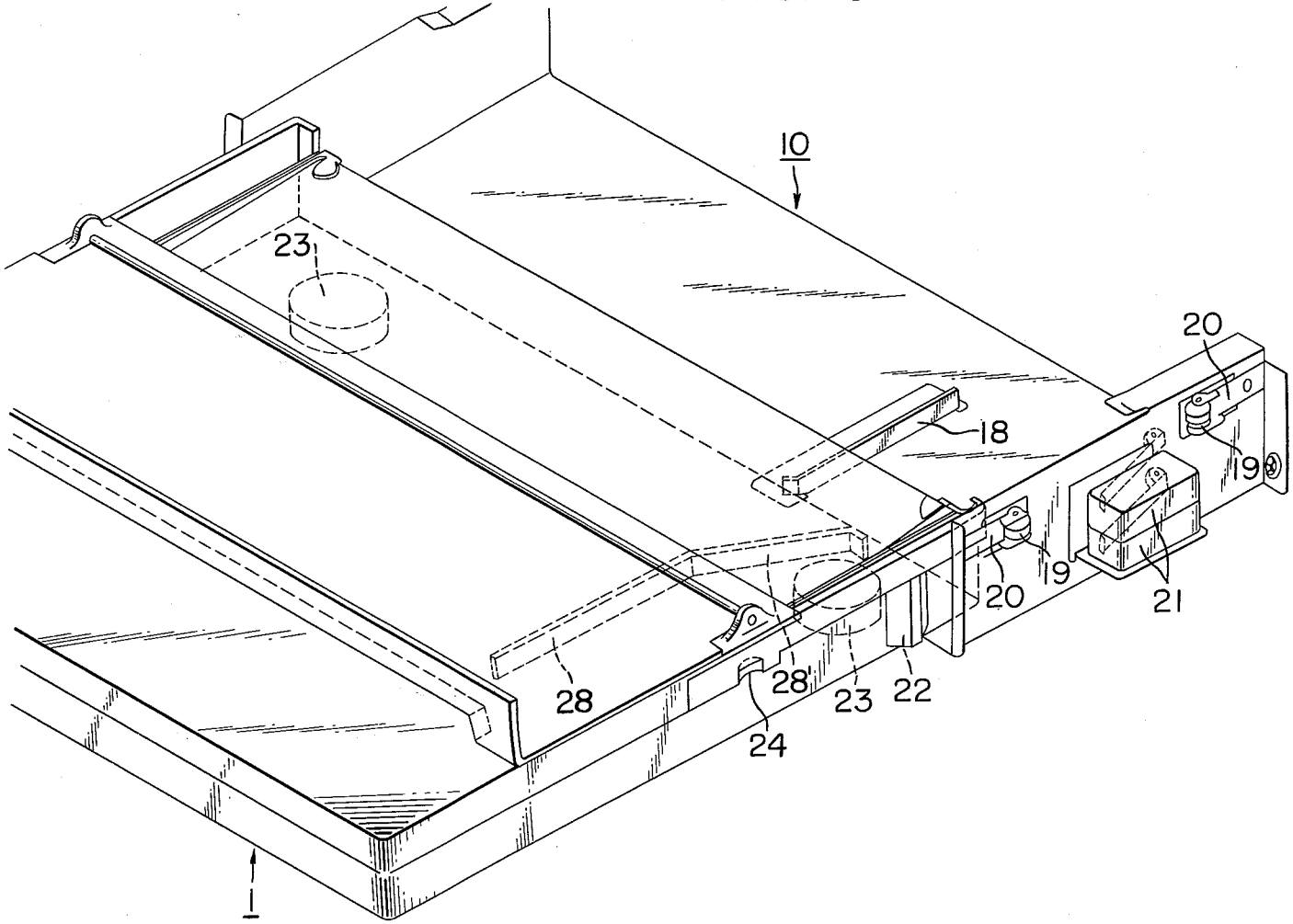
FIG. 5 is a perspective view of the loading device.

Referring to FIG. 2, the feed cassette 1 has at one side thereof regulating portions 15 and 16 for regulating the positions of the copy mediums 6, and at the opposite side an abutment portion 17 movable in the direction in which the position of the copy mediums is regulated. Details of the abutment portion 17 are shown in FIG. 4. Designated by 25 is a side keeper for pushing one side edge of the copy mediums contained in the cassette, and it is normally urged inwardly of the cassette housing 2 by a spring 26 to urge the inner surface of a cushion material 27 such as foamed plastics or the like, provided on the inner surface of the side keeper, against the one side edge of the copy mediums 6. The side keeper 25 is provided to ensure the copy mediums to be separated one by one at a time. By the action of the abutment portion 17, the other side edge of the copy mediums 6 may be regulated to the position of the regulating portions 15 and 16, independently of the expansion or shrinkage of the copy mediums attributable to irregularity of the paper cutting, variations in the atmosphere, etc. Also, a cassette positioning guide 28 is projectedly provided in the bottom of the cassette 1. The cassette table 10 according to the present invention, as shown in FIG. 5, further has a positioning member 18 and has at one side thereof spring members 20 holding rollers 19. A group of microswitches 21 is provided which may be actuated by a cam 22 provided on the cassette 1. The configuration of the cam 22 is variable with the type of the cassette, namely, the size of the copy mediums, and in accordance therewith, the group of microswitches 21 may generate specific signals. By these signals, optical scanning means may have its scanning distance controlled. Thus, the optical scanning means may effect the minimum necessary scanning corresponding to the size of the copy medium, thereby eliminating time losses due to scanning. In addition, the group of microswitches 21 also has the function of detecting whether or not the cassette has been set to a predetermined position in the body of the copying machine.

With the above-described construction of the loading device for the present feed cassette device, the loading of the feed cassette may be accomplished simply by placing the legs 23 of the cassette 1 on the cassette table 10 and pushing the cassette into the machine body while accurate positioning of the cassette may also be achieved. More specifically, as the cassette 1 is inserted into the machine body, the inclined portion 28' of a positioning guide 28 follows the positioning member 18 so that the cassette always undergoes a force imparted by the spring member 20 in the direction in which it is urged against the positioning member 18 of the cassette table 10 with the roller 19 interposed therebetween until it is loaded into a proper position. When the cassette is inserted to a predetermined position, the roller 19 of the cassette table 10 is received into a recess 24 formed in the cassette 1 to hold the cassette 1. Further, in the present device, all the operative forces of the switches for controlling the scanning distance of the optical scanning means in accordance with the type of the cassette or the size of the copy medium and for detecting whether or not the cassette has been accurately set to the predetermined position in the machine body act as the force which directs and pushes the cassette toward the predetermined position, and this serves to increase the stability with which the cassette is loaded.

Also, a concept of the present invention consists in providing, in the so-called cassette system wherein cassettes respectively containing therein different types or sizes of copy mediums are selectively loaded onto the cassette table in the machine body to feed a desired type or size of copy mediums, a cassette loading device which will permit the overall size of the cassette to be variable with the size of the copy medium contained therein and which will rationally match the system adopting one edge of the copy medium as the reference. In such system, it is not possible to endow that edge of the cassette table opposite from the reference edge with the function of guiding the cassette and thus, the cassette positioning member 18 is provided in the bottom of the cassette table. By doing so, the positioning guide portion may be provided at a short distance from the regulating portions 15, 16 within the cassette, thereby minimizing the manufacturing error.

As described above, according to the feed cassette loading device in the present cassette device, the position of the copy mediums in the feed cassette is reliably regulated and there is no clearance between the feed cassete 1 and the cassette table 10, which also leads to elimination of any lateral deviation of the copy mediums with respect to their regular loaded position and highly accurate positioning of the copy mediums. Moreover, there is an advantage of excellent operability.

Figure 6:
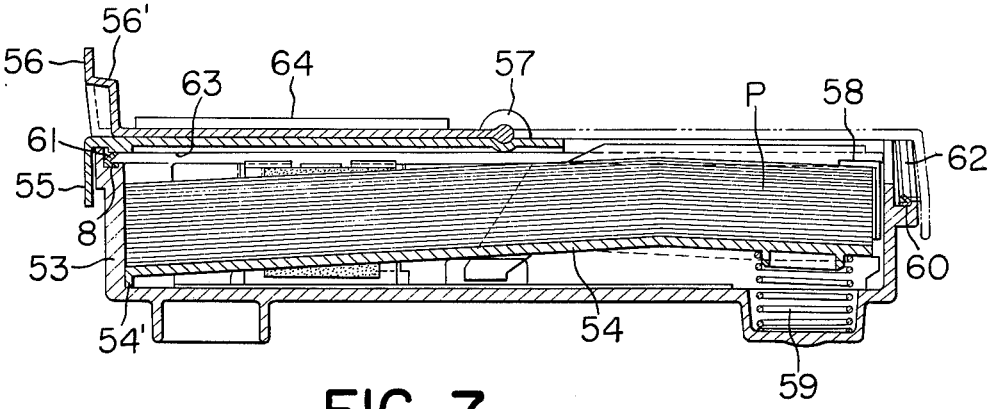
FIG. 6 is a vertical cross-section of another feed cassette device according to the present invention.
Figure 7:
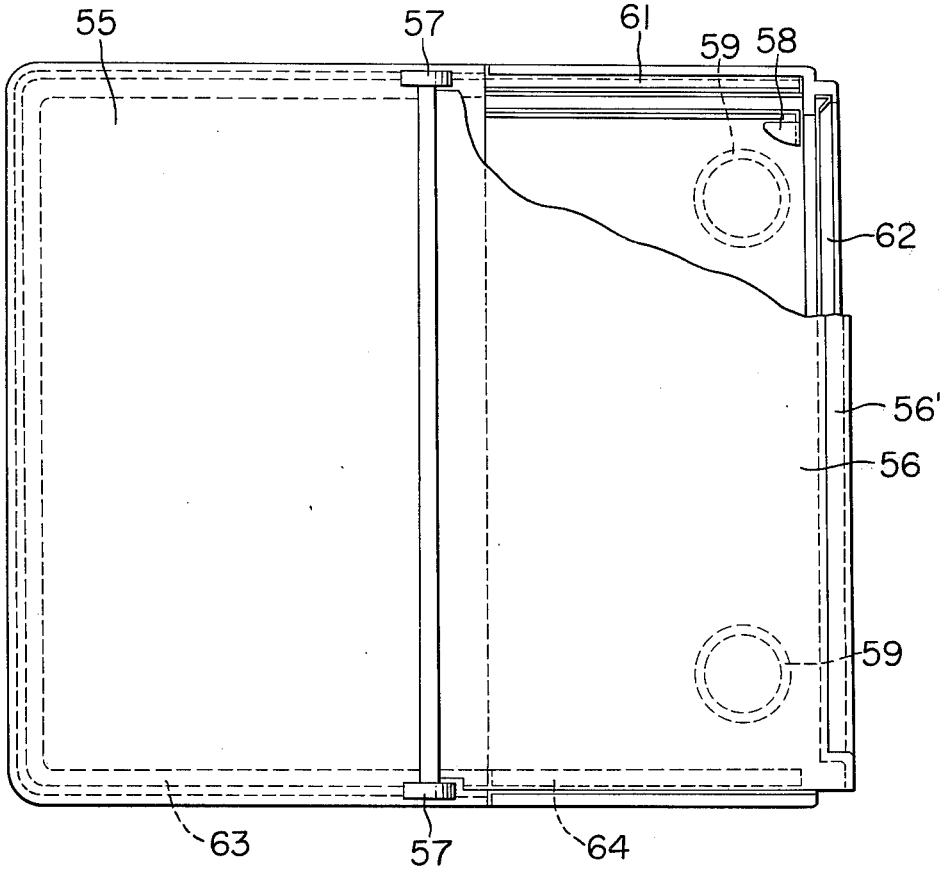
FIG. 7 is a plan view corresponding to FIG. 6.

Now, the feed cassette will further be described. FIGS. 6 and 7 are a vertical cross-section and a plan view, respectively, of the present feed cassette. The feed cassette includes a cassette housing 53, an intermediate plate 54 for supporting thereon copy mediums P, a fixed lid 55, an openable lid 56 attached to the lid 55 by means of a hinge 57, and vertically movable copy medium separator pawls 58 provided at the forward end corners of the housing 53. As the copy mediums P on the intermediate plate 54 are depressed to a predetermined position by a feed roller (not shown) in the copy medium body, the separator pawls 58 may follow the copy mediums P from the gravity thereof. Designated by 59 is a spring designed for urging the copy mediums P against the lower surfaces of the separator pawls 58 to cause the uppermost one of the copy mediums P to be fed past the separator pawls by the unshown feed roller in the copying machine body and for raising the intermediate plate 54 with its rear end 54' as the fulcrum in accordance with the consumption or decrease of the copy mediums to always maintain a constant contact pressure of the copy mediums P with respect to the feed roller. The cassette housing 53 also has a seat 60 provided around the periphery thereof to which are attached moisture-proof packings 61 and 62 each having a lip of rubber or like resilient material. A fixed lid 55 and an openable lid 56 have contact surfaces 63 and 64 provided at locations corresponding to the moisture-proof packing 61, and the openable lid 56 also has a recessed portion 56' provided at a position corresponding to the moisture-proof packing 62.

Figure 9:
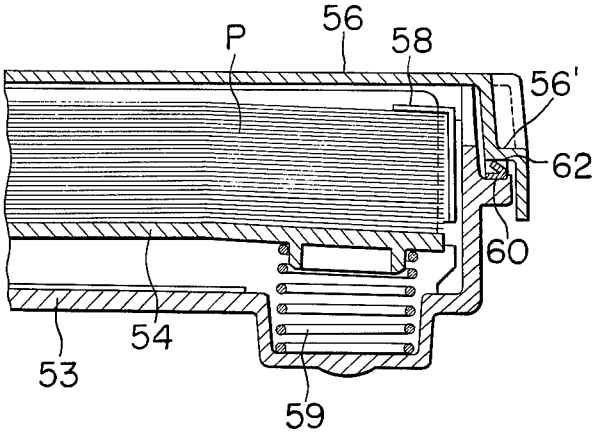
FIG. 9 is a fragmentary cross-section of the openable lid when in its closed position.

As illustrated in FIG. 9, when the movable lid portion 56 is pivoted and then pressed downwardly into its closed position, the moisture proof material 62 is compressed, thereby sealing the illustrated clearance area between the front wall of the cassette and the cover portion 56.

The present feed cassette constructed as described above is inserted into the copying machine body with the openable lid 56 opened as indicated by solid line in FIG. 6. When the cassette housing 53 has been removed from the machine body, the openable lid 56 is closed as indicated by broken line in FIG. 6 or 9. Thus, the cassette housing 53, even if it is left with the copy mediums P contained therein, may be shielded against external light and dust by the lids 55 and 56 while the copy mediums in the cassette may be shielded against the atmosphere by the packings 61 and 62. As the result, the copy medium is protected even if the ambient conditions are varied.

Figure 10:
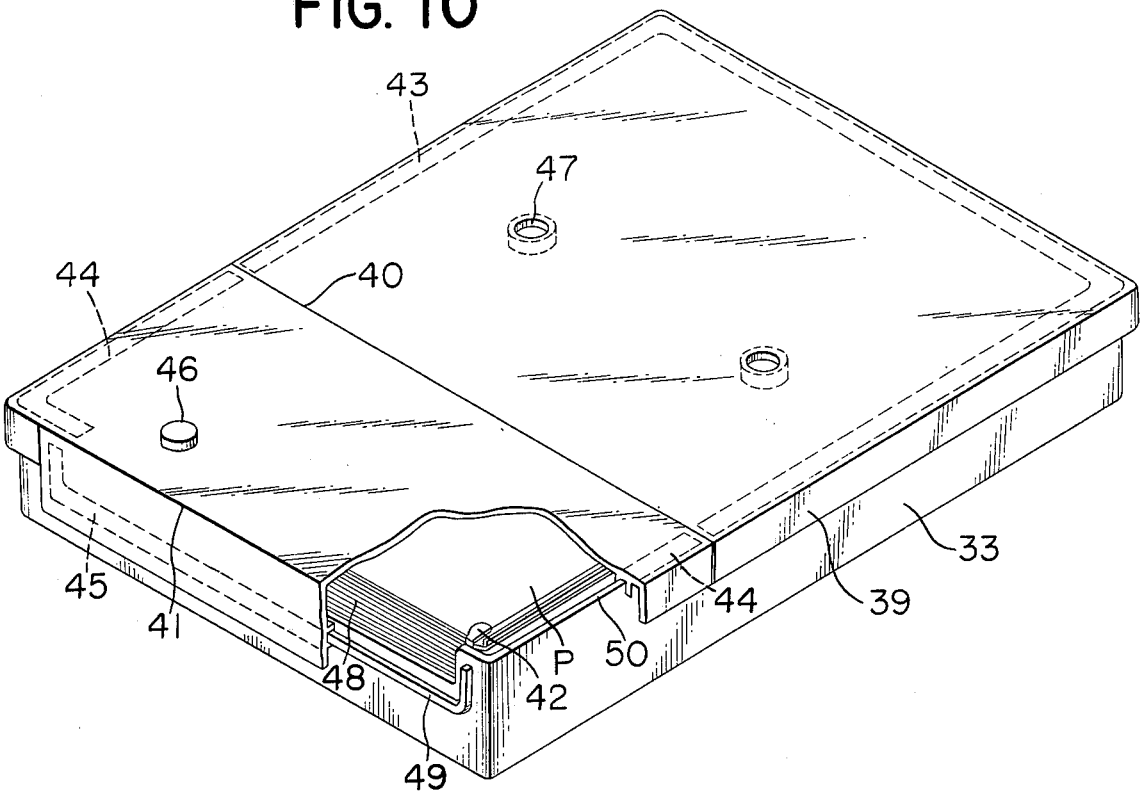
FIG. 10 is a perspective view of the present feed cassette device.

Still another feed cassette device will now be described. In FIG. 10, the cassette housing is designated by 33 and accommodates therein an intermediate plate (not shown) for supporting thereon a stock of copy mediums P, separator pawls 42 vertically movably provided at the forward end corners of the housing, and a spring (not shown) designed to urge the stock of copy mediums against the lower surfaces of the separator pawls 42 and to maintain a constant contact pressure of the stock of copy mediums with respect to the feed roller provided in the body of the copying machine. A lid 39 is formed of a high molecular material such as plastics or the like and has hinge-functioning sections 40 and 41 locally reduced in thickness so as to function as a hinge. The lid 39 also has seal-functioning sections 43, 44 and 45 provided around the inner peripheral edge thereof.

The lid 39 further has projected portions 46 in the forward portion thereof, and recessed portions 47 formed at positions symmetrical with the projected portions 46 about the hinge-functioning section 40. In the front end portion of the cassette housing 33, a rib 49 is provided adjacent to the outer periphery of a cut-away portion 48 which provides a passage for the copy mediums when fed.

Figure 11:
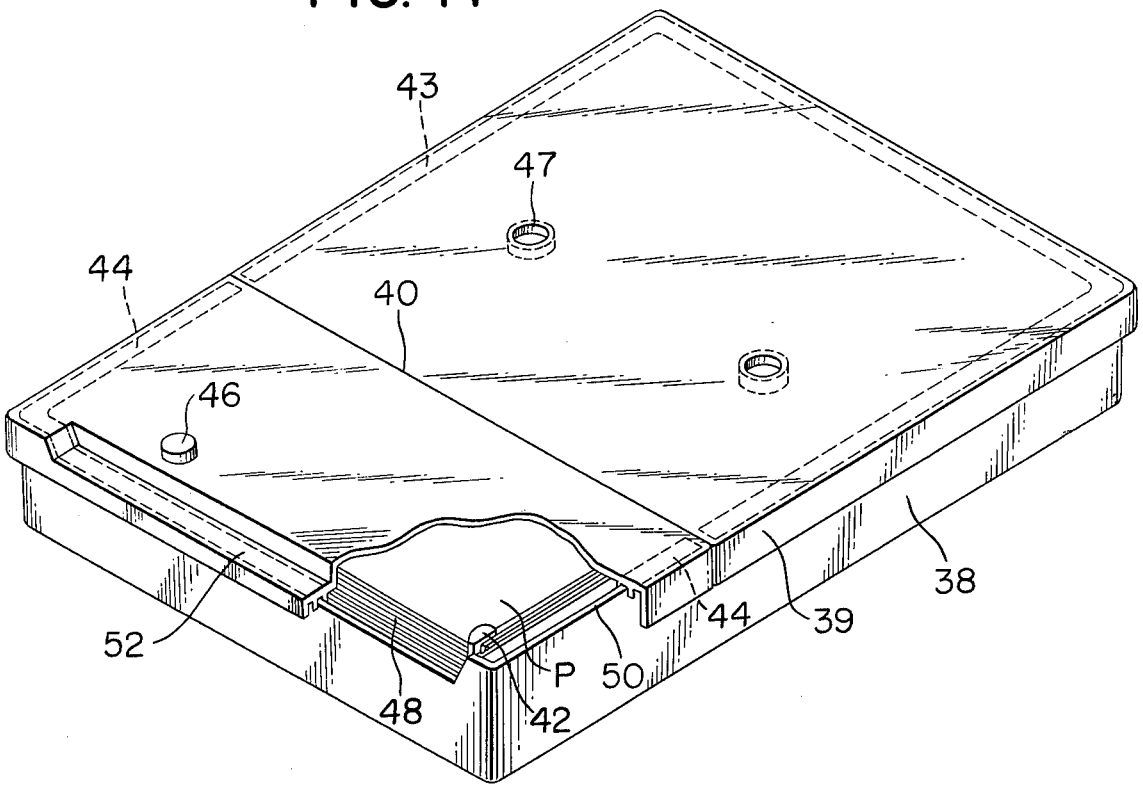
FIG. 11 is a perspective view of another embodiment of the feed cassette device.

FIG. 11 shows another embodiment of the feed cassette. A lid 39 is formed of a high molecular material such as plastics or the like and has a hinge-functioning section 40 locally reduced in thickness so as to function as a hinge. In the forward end portion of the lid 39, a recessed portion 52 is formed to correspond to a cut-away portion 48 formed in the cassette housing 38. The lid 39 also has seal-functioning sections 43 and 44 provided around the peripheral edge thereof.

Figure 12:
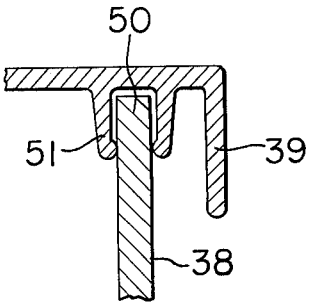
FIG. 12 is an enlarged fragmentary view showing the seal-functioning section.

FIG. 12 is a cross-sectional view showing a form of the seal-functioning sections 43, 44 and 45. In the inner surface of the lid 39, there are provided resilient fin-like projections 51 which are in tight fit relationship with the upper edge portion 50 of the cassette housing 38.

Figure 8:
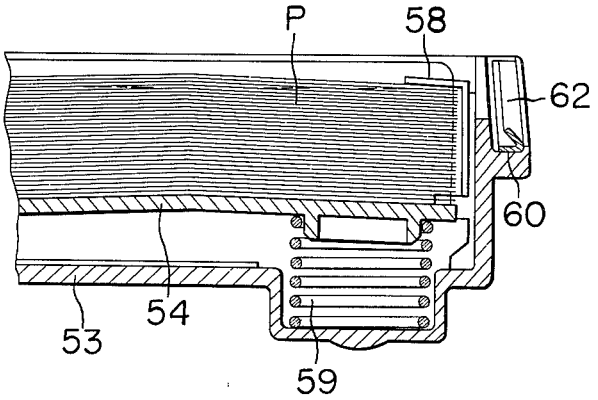
FIG. 8 is a fragmentary cross-section of the openable lid when in its open position.

With the above-described construction of the present feed cassette device, only that portion of the lid 39 which lies forwardly of the hinge-functioning section 40 may be opened and turned back when it is desired to load the cassette housing 38 into the copying machine body. Thereupon, the projected portions 46 fit in the recessed portions 47 to thereby maintain the open position stable. When it is desired to remove the cassette housing 38 from the machine body, that portion of the lid which lies forwardly of the hinge-functioning section 40 may be closed in the manner as shown in FIG. 10 or 11, whereupon the seal-functioning section 44 fits to the upper edge portion 50 of the cassette housing 38 while the seal-functioning section 45 fits to the rib 49 (in the case of the FIG. 8 embodiment), whereby the interior of the cassette is shielded against the atmosphere. Thus, the copy mediums in the cassette are in no way affected by the atmosphere.

What is claimed is:

1. A feed cassette device for a copying machine comprising:

a cassette having side plates, and having a bottom plate connecting the side plates, for storing copy mediums therein, said bottom plate having a guide member projecting downwardly therefrom for use in aligning said cassette on said machine;

a cassette table for receiving said cassette thereon, said cassette table having a positioning member and a member for contacting one of said side plates to urge said cassette guide member into engagement with said positioning member to properly align said cassette on said table; and lock means for locking said cassette in a predetermined position on said cassette table.

2. A feed cassette device according to claim 1, wherein said cassette has at one side thereof a copy medium regulating portion, and at the opposite position thereto an abutment portion movable in the direction in which the copy mediums are regulated.

3. A feed cassette device according to claim 1, wherein said lock means comprises a recessed portion formed in said cassette and a roller member provided on said cassette table.

4. A feed cassette device according to claim 1, wherein a grooved portion is provided around the periphery of the body of said cassette, a packing member having a lip is disposed in said grooved portion, and an outer cassette lid having a projected portion is provided on said cassette to provide hermetic sealing with said lid bearing against the lip of said packing member.

5. A feed cassette device according to claim 1, wherein the lid of said cassette is formed into an openable lid portion and a fixed lid portion, said openable lid portion comprising a hinge-functioning section provided by a boundary portion between said openable lid portion and said fixed lid portion which is locally reduced in thickness so as to function as a hinge, and a seal-functioning portion for providing hermetic sealing by means of a fin-like projection, said openable lid portion being formed integrally with said fixed lid portion.

6. A feed cassette device for a copying machine as set forth in claim 1, wherein said cassette body has an opening defining first and second adjacent portions; a first covering member for hermetically covering said first portion of the opening of said body; a second covering member swingably movable between an open position wherein said second portion of the opening of said body is exposed and a closed position wherein the second portion of the opening is closed; and a resilient sealing member for hermetically sealing a clearance between said body and said second covering member when said second covering member is in its closed position, said sealing member being compressed when said second covering member is in its closed position, wherein the direction of compression of said resilient member is the same as a direction of closing movement of said second covering member.

7. A feed cassette according to claim 6, wherein said sealing member further includes a sealing lip supported within a groove provided in said body around the first portion of said opening.

8. A feed cassette according to claim 1, wherein said cassette body has an opening defining first and second adjacent portions; a first covering member for hermetically covering said first portion of the opening of said body; a second covering member swingably movable between an open position wherein said second portion of the opening of said body is exposed and a closed position wherein the second portion of the opening is closed; and a sealing member including fin-like projections disposed in parallel on said second covering member for engaging an upper edge of said cassette body at said second opening thereof to hermetically seal said second opening at said engagement.

* * * * *